US007195498B1

(12) United States Patent
Wang et al.

(10) Patent No.: US 7,195,498 B1
(45) Date of Patent: Mar. 27, 2007

(54) SURFACE-MOUNT CONNECTOR WITH ANTI-WICKING STRUCTURE

(75) Inventors: Zhen-Hua Wang, Kunshan (CN); Xiao-Gao Yang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/527,287

(22) Filed: Sep. 26, 2006

(30) Foreign Application Priority Data

Sep. 28, 2005 (CN) ..... 2005 2 0076111

(51) Int. Cl.
*H01R 12/00* (2006.01)

(52) U.S. Cl. ..... 439/83

(58) Field of Classification Search ..... 439/83, 439/79, 328
See application file for complete search history.

(56) References Cited

U.S. PATENT DOCUMENTS

| | | | | |
|---|---|---|---|---|
| 5,547,384 | A * | 8/1996 | Benjamin | 439/79 |
| 5,735,696 | A | 4/1998 | Molex | |
| 6,095,827 | A * | 8/2000 | Dutkowsky et al. | 439/83 |
| 6,254,429 | B1 | 7/2001 | Hirose | |
| 6,811,433 | B2 * | 11/2004 | Jou | 439/541.5 |
| 2003/0224632 | A1 * | 12/2003 | Regnier et al. | 439/79 |

* cited by examiner

*Primary Examiner*—Tho D. Ta
(74) *Attorney, Agent, or Firm*—Wei Te Chung

(57) ABSTRACT

A surface-mount connector (100) comprises an insulating housing (1) defining passageways thereon and a plurality of contacts (2) arranged in the passageways. Each contact comprises a soldering section (33) extending out the housing, an engagement point (321) and a middle portion connecting the soldering section and the engagement point. The middle portion touches at least one sidewall of each passageway, and a cutout (17) is formed on said at least one sidewall of the passageway to space the middle portion from said at least one sidewall.

13 Claims, 4 Drawing Sheets

SURFACE-MOUNT CONNECTOR WITH ANTI-WICKING STRUCTURE

BACKGROUND OF THE INVENTION

1. Field of the Invention

The present invention relates to a surface-mount connector, and more particularly to a surface-mount connector with anti-wicking structures.

2. Description of the Related Art

Conventional surface-mount connectors, such as board-to-board connectors and DDR connectors, generally are fixed to a board by soldering a plurality of contacts which are retained in the connector. Each contact comprises a soldering leg extending out of an insulating housing of the connector at one end thereof, a contacting portion at another end and the middle portion between said two. The middle portion usually is embedded in the passageways of the housing. When soldering the soldering leg to traces of the board through an appropriate heat means, such as infrared oven, a combination of solder paste and flux will climb up along a slight clearance between the middle portion and sidewalls of the passageways by capillary effect, which is named as wicking in technology. The climbed combination will contaminate the contacting portions of the contacts and decrease performance of the connector. The wicking is more serous in low-profile, height-density connectors.

Hence, an improved surface-mount connector is desired to overcome above problems.

BRIEF SUMMARY OF THE INVENTION

It is an object of the present invention to provide a surface-mount connector, which has improved anti-wicking characteristics during process of mounting the connector to a circuit board.

In order to obtain the objective above, a surface-mount connector comprises an insulating housing defining passageways thereon and a plurality of contacts arranged in the passageways. Each contact comprises a soldering section extending out the housing, an engagement point and a middle portion connecting the soldering section and the engagement point. The middle portion touches at least one sidewall of each passageway, and a cutout is formed on said at least one sidewalls to space the middle portion from said at least one sidewall.

Other objects, advantages and novel features of the invention will become more apparent from the following detailed description of the present embodiment when taken in conjunction with the accompanying drawings.

DETAILED DESCRIPTION OF THE INVENTION

Figure 1:
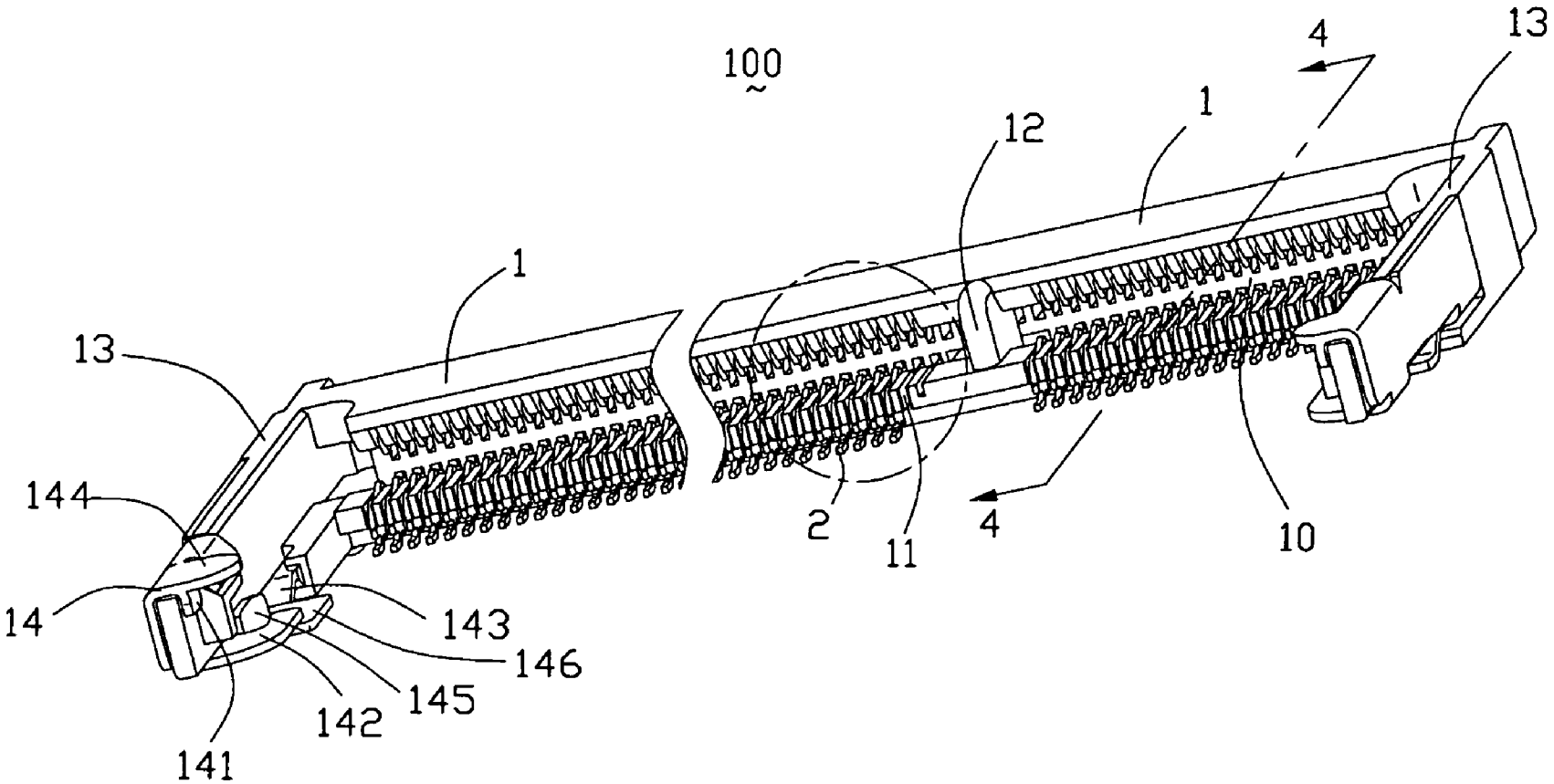
FIG. 1 is a perspective view of a surface-mount connector according to an embodiment of the invention.

With reference to FIG. 1, a surface-mount connector 100 according to one embodiment of the present invention is adapted for receiving an electrical card, such as DDR.

The connector 100 includes an elongated insulating housing 1. The housing 1 defines a longitudinal card-receiving slot 10 and two rows of contact-receiving passageways 11 along the opposite top and bottom inner surfaces of the slot 10 to receive a plurality of contacts 2. A key 12 is defined in the slot 11 at predetermined place to prevent from anti-mating of the card. A pair of arm portions 13 respectively extends from two opposite ends of the housing 1 and a metal portion 14 is disposed on each arm portion 13. The metal portions 14 mainly abut against the outmost walls of the arm portions 13. A semi-circular locking portion 144, extending from the front top edge of the metal portion 14, spans the front top portion of the arm portion 13 to lock the card in the connector. A L-shaped portion 142 is formed with extending inward from the front bottom portion of the metal portion 14 and then vertically backwards bending. One end 143 of a solder pad 146 is retained in the arm portion and another end 145 is upright to encounter the distal end of the L-shaped portion 142. The distal end of the L-shaped portion 142 and the upright end 145 can prevent excessive out-movement of the arm portion 13. A rib 141 extends downwards from the locking portion 144 to clip the front top portion of the am portion 13 with the metal portion 14.

Figure 3:
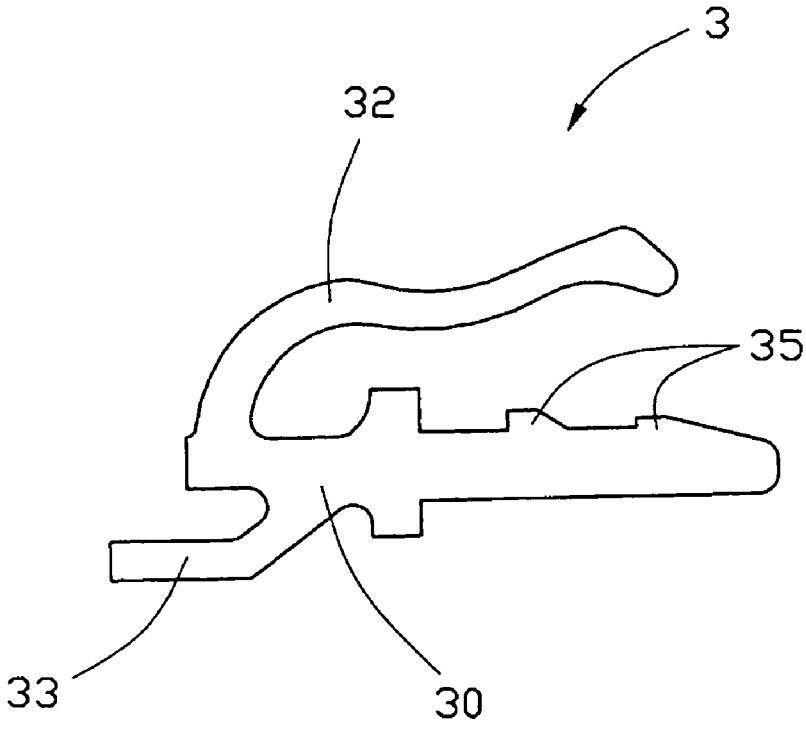
FIG. 3 is an elevational view of a contact of lower row.
Figure 4:
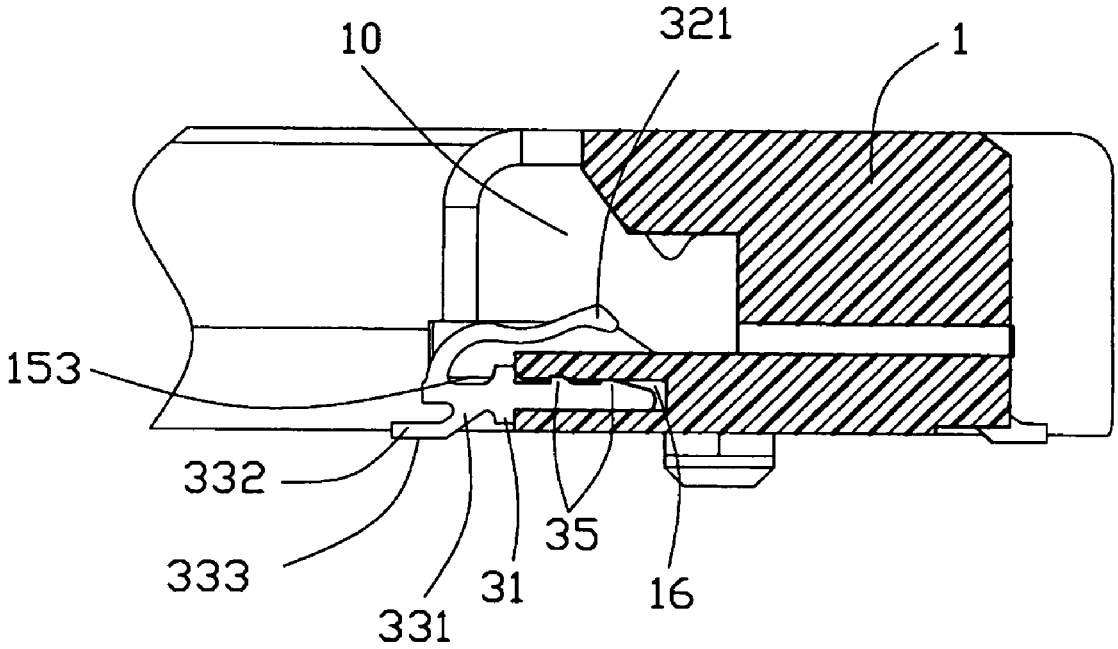
FIG. 4 is an sectional view taken along line 4—4 of FIG. 1.

Referring to FIG. 3, each lower contact 3 includes an elongated retention section 30 with tabs 35 on its upper edge, a cantilever resilient contact section 32 extending from one end of the retention section 30, and a soldering section 33 extending from the lower edge of said one end of the retention section 30. As FIG. 4 shown, the lower contacts 3 are retained in the contact-receiving passageways with its tabs 35 secured in the a retention slit 16. Two block portions 31 on the retention section encounter the front of the retention slit 16 to prevent the contact from turning. The contacting sections 32 extend into the slot 10 with an engagement point 321. The solder sections 33 extend out of the insulating housing 1 and each comprises a parallel portion 332 and a downward-slanting portion 331 connecting the parallel portion 332 with the retention section 30. The parallel portion 333 defines its bottom surface as a soldering face 333 to solder its on a circuit board.

Figure 2:
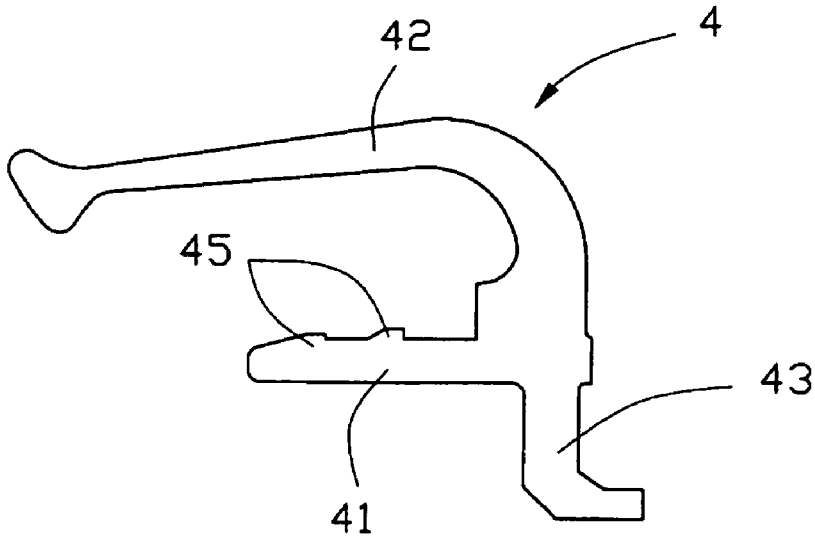
FIG. 2 is an elevational view of a contact of upper row.

Referring to FIG. 2, each upper contact 4 is similar to the lower contact 3 and also includes a retention section 41 with tabs 45, a cantilever resilient contacting portion 42 and a solder section 43 extending out the housing.

Figure 5:
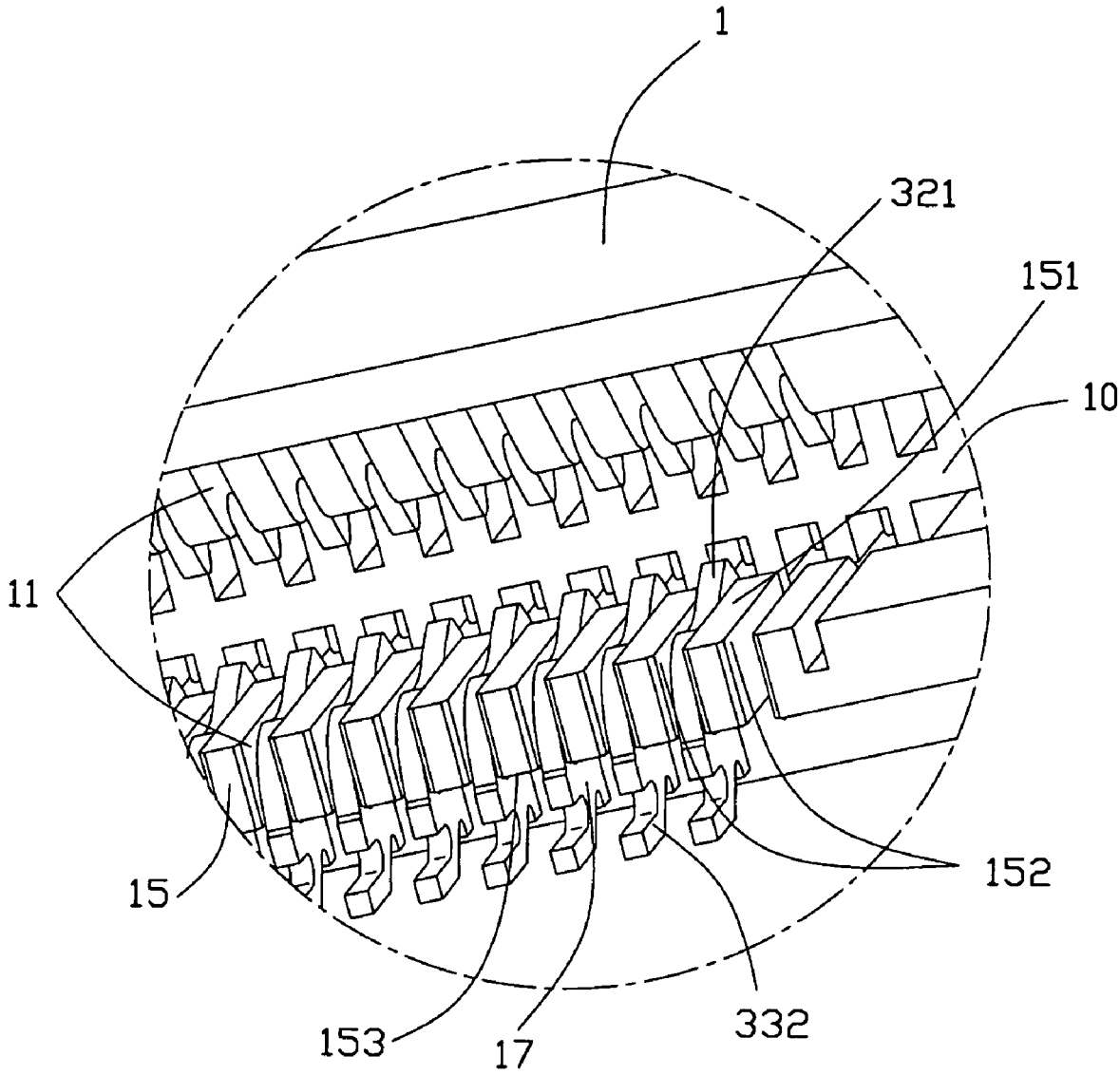
FIG. 5 is an enlarged perspective view of the electrical connector showing in FIG. 1.

Referring to FIGS. 4–5, two neighboring passageways 11 are separated by a partition 15. The retention sections 30, 40 retain the contacts in the passageways 11, and the engagement points 321 extend beyond top faces 151 of the partitions 15. The insertion of the card into the card-receiving slot 10 will resiliently press downwards the contacts, especially the cantilever resilient contacting portion 32. So the contacts are accommodated in the passageways with its sides close to the sidewalls 152 of the passageways/the partitions, but separate with slight clearance, which result in wicking sometimes. The improvement of this invention is that each partition 15 is partially cut out. A part of each partition 15 adjacent to the soldering section 33 is taken away to form a cutout 17 as FIG. 5 shown, and parts of the neighboring retention sections 31 are exposed to face each other, i.e. a bottom face 153 of each partition is beyond a corresponding jointing line at which the soldering section connects with the retention section of the contact in a direction that opposite to that the soldering section extends. Therefore the enlarged distance between the sides of the contacts and the sidewalls of the passageways prevents the solder paste and flux from climbing up by capillary effect, i.e. anti-wicking. Alternatively, the cutouts 16 may be recessed into the sidewalls 152 of the partition 15 and throughout the middle portion transversely, not throughout when width of the partitions is enough. Or the cutouts are defined correspondingly to a middle portion thereinto, the middle portion including parts between the engagement portion 321 and the soldering section of the contacts. All cutouts cut off the climbing traces of solder paste, and the function of anti-wicking is obtained.

The wicking of soldering paste might occur in conventional low profile BTB connector. Plate middle portions of contacts are embedded in shallow recesses in the outer/inner sidewalls of the BTB connector with soldering section extending out of the sidewalls. The solder paste will climb up along clearances between the sidewalls and the contacts. As improvement, a part of each sidewall near to the soldering section is partially cut off to increase width of the clearance, and the middle portions of the neighboring contacts partially exposed to each other, which obtain anti-wicking function.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A surface-mount connector comprising:

an insulating housing defining passageways thereon;

a plurality of contacts arranged in the passageways, each contact comprising a soldering section extending out the housing, an engagement point and a middle portion connecting the soldering section and the engaging point, the middle portion touching at least one sidewall of the passageway; wherein a cutout is formed on said at least one sidewall to space the middle portion from said at least one sidewall;

wherein the insulating housing comprises partitions each between two neighboring passageways and a part of each partition corresponding to the middle portion is removed away to form said cutout;

wherein the middle portions near to the soldering sections of neighboring contacts are exposed to face each other.

2. The surface-mount connector according to claim 1, wherein the cutout is formed adjacent to the soldering section of the contact.

3. The surface-mount connector according to claim 1, wherein the cutout is defined throughout the middle portion of the contact transversely.

4. The surface-mount connector according to claim 1, wherein each contact comprises a retention section to retain the contact in the housing and a cantilever contacting section, the soldering section and the contacting section extends at one end of the retention section along two opposite directions and the engagement point is on the contacting section.

5. The surface-mount connector according to claim 1, wherein the insulating housing defines an elongate slot, the passageways are arranged on two opposite sidewalls of the slot and the engagement points project into the slot.

6. The surface-mount connector according to claim 5, wherein said passageways are arranged in an upper and a lower rows, and the cutouts are on the at least one sidewall of the lower row.

7. The surface-mount connector according to claim 1, wherein the insulating housing comprises a pair of arm portions extending from two opposite ends thereof and a pair of metal portions arranged on the arm portions.

8. The surface-mount connector according to claim 7, wherein the metal portions abut against outsides of the arm portions, and each comprises a locking portion spanning a front top portion of the arm portion and means at a lower portion of the arm portion for preventing over-movement of arm portion.

9. The surface-mount connector according to claim 8, wherein said means comprises a L-shaped portion extending from a front bottom portion of the metal portion and a solder pad with an upright end, and the distal end of the L-shaped portion encounters the upright end when the over-movement occurs.

10. A surface-mount connector comprising:

an insulating housing defining passageways thereon;

a plurality of contacts received in the passageways, each contact comprising a retention section retained in the housing, and a contacting section and a soldering section extending from one end of the retention section in different directions;

wherein each contact touches at least one sidewall of corresponding passageway and a bottom face of said at least one sidewall is beyond a jointing line at which the soldering section connects with the retention section in a direction opposite to that the soldering section extends;

wherein the insulating housing comprises partitions each between two neighboring passageways and sidewalls of the partitions form said at least one sidewall.

11. A surface-mount connector comprising:

an insulative housing defining a horizontal central slot with a plurality of horizontal passageways located below said horizontal central slot and forwardly communicating with an exterior, each of said passageways further communicating with the exterior in both upward and downward directions around a front face of the housing;

a partition of the housing being formed between every adjacent two of said passageways;

a plurality of contacts disposed in the corresponding passageways, respectively; and a bottom face of each of said partitions adjacent to a front face of the housing is located above a horizontal middle section of the corresponding contact under a condition that an upper contact section and a lower tail section of the corresponding contact respectively extend from said horizontal middle section.

12. The connector as claimed in claim 11, wherein a shoulder is formed in each of said passageways so as to forwardly abut against a retention section of the corresponding contact.

13. The connector as claimed in claim 12, wherein the partition extends forwardly beyond the corresponding shoulder aside.

* * * * *